US010709992B2

(12) United States Patent
Cragle

(10) Patent No.: US 10,709,992 B2
(45) Date of Patent: Jul. 14, 2020

(54) RETROFIT-DECORATIVE DOORSTOP

(71) Applicant: Mark Cragle, Carrollton, TX (US)

(72) Inventor: Mark Cragle, Carrollton, TX (US)

( * ) Notice: Subject to any disclaimer, the term of this patent is extended or adjusted under 35 U.S.C. 154(b) by 0 days.

(21) Appl. No.: 16/003,351

(22) Filed: Jun. 8, 2018

(65) Prior Publication Data

US 2019/0374864 A1 Dec. 12, 2019

(51) Int. Cl.

*A63H 3/00* (2006.01)
*E05F 5/00* (2017.01)
*A63H 3/50* (2006.01)

(52) U.S. Cl.

CPC ..... *A63H 3/003* (2013.01); *A63H 3/006* (2013.01); *A63H 3/50* (2013.01); *E05F 5/00* (2013.01); *E05Y 2900/132* (2013.01)

(58) Field of Classification Search

CPC ..... A63H 3/003; A63H 3/006; A63H 3/04; A63H 3/48; E05Y 2900/132
USPC ..... 446/71, 72, 73, 369; 292/288, 289, 342, 292/343
See application file for complete search history.

(56) References Cited

U.S. PATENT DOCUMENTS 3,448,539 A * 6/1969 Hartpence ..... A63H 3/04 446/373
3,928,933 A * 12/1975 Iwamoto ..... A63H 3/04 446/330
4,152,865 A * 5/1979 Ikeda ..... A63H 37/00 40/119
4,226,046 A * 10/1980 Delhome ..... B29C 61/02 446/385
4,407,090 A * 10/1983 Pyo ..... A63H 3/31 446/184
4,505,687 A * 3/1985 Munro ..... A63H 3/04 446/26
4,755,160 A * 7/1988 Autore ..... A63H 3/02 446/369
5,078,640 A * 1/1992 Berman ..... A63H 3/003 135/73
5,288,257 A * 2/1994 Zacherl ..... A63H 3/36 16/82
5,378,188 A * 1/1995 Clark ..... A63H 3/20 446/330
5,480,340 A * 1/1996 Bogar ..... A63H 3/003 446/227
5,873,146 A * 2/1999 Mungo ..... E05F 5/02 16/374
6,142,846 A * 11/2000 Ojakaar ..... A63H 3/006 446/369
6,170,721 B1 * 1/2001 Chen ..... A47G 25/0671 223/85
D472,458 S * 4/2003 Mariuz ..... D8/403
6,699,100 B1 * 3/2004 Burns ..... A63H 3/003 446/369
7,766,400 B2 * 8/2010 Predebon ..... E05C 17/54 16/82
9,074,395 B2 * 7/2015 Packer ..... E05C 17/54
9,074,396 B2 * 7/2015 Packer ..... E05C 17/54
(Continued)

*Primary Examiner* — Alexander R Niconovich
(74) *Attorney, Agent, or Firm* — Polsinelli PC; Adam C. Rehm

(57) ABSTRACT

A retrofit decorative doorstop comprising a plush figure having a plurality of appendages and a clamp having a pair of arms positioned in adjacent ones of the door therebetween and/or to prevent the door from abutting a portion of a doorframe.

20 Claims, 7 Drawing Sheets

(56) References Cited

U.S. PATENT DOCUMENTS

| | | | | |
|---|---|---|---|---|
| 9,370,723 | B2 * | 6/2016 | Lau | A63H 3/20 |
| 2006/0011786 | A1 * | 1/2006 | Finney | A47C 7/72 248/118 |

* cited by examiner

RETROFIT-DECORATIVE DOORSTOP

BACKGROUND

1. Field

The following description relates to doorstops and, more specifically, to a retrofit-decorative doorstop operable to be secured to a door, thereby providing an obstruction between the door and a door jamb to prevent the door from fully closing.

2. Description of Related Art

Every year, more than 300,000 door-related injuries requiring emergency room treatment occur, with most injuries occurring in children under the age of four. These injuries not only cause pain, trauma, or in serious cases, amputations, they can be distressing to a witness, e.g., a parent of an injured child. As such, a door related injury can be traumatic for an entire household.

Conventional devices designed to prevent doors from closing suffer from various deficiencies and may give a false sense of security, and present further scenarios for injury. For example, U.S. Pat. No. 4,811,454 discloses a multi-piece door stay having an elastic ring attachable to a doorknob, a flexible belt attached to a bracket attached to a wall, and a device attached to the bracket by the flexible belt and to the elastic ring. The door stay of patent No. '454 is problematic as it involves multiple moving parts that may wear out or break into smaller pieces, which may be swallowed by a child or animal, and if not properly installed may give a false sense of security that the door is held open. In another example, U.S. Pat. No. 5,288,257 discloses another door stay having suction cups to position multiple rods on either side of the door, which is problematic if the suction cups cannot adhere to the material of the door and/or the suction cups wear out and/or lose their suction. In yet another example, U.S. Pat. No. 7,766,400 discloses another door stay having a band operable to wrap the door stay around doorknobs on either side of the door, which is problematic as a child or an animal can reach the door stay and knock or pull the door stay off of the door. In another example, U.S. Pat. No. 9,074,396 discloses yet another door stay operable to be mounted on a top of the door by an elastic cord coupling two bodies, which is problematic as the elastic cord can wear out and/or break. In an additional example, U.S. Patent Application Publication No. 2006/0163888 discloses another door stay operable to attach to a bottom of the door adjacent to the floor, which may cause a person to trip and/or can be removed by a child or animal.

Accordingly, there exists a need for a door stay that does not suffer from the aforementioned deficiencies, that is operable to prevent a door from fully closing and is strong, easy to use, and safe for children.

SUMMARY

The present inventive concept generally provides a decorative doorstop via a clamp retrofitted to a plush figure. The doorstop is operable to be secured to a door, thereby providing an obstruction between the door and a door jamb, which prevents the door from abutting a doorframe and fully closing.

An object of the present inventive concept is to provide a doorstop operable to be positioned to a door at any point along a side of the door and/or along a top of the door.

Another object of the present inventive concept is to provide a doorstop that has additional functionality, e.g., provides one or more sources of light, thereby allowing a user to illuminate a room, and is decorative, thereby providing an aesthetically-pleasing appearance.

Another object of the present inventive concept is to provide a doorstop that is simple to manufacture, durable, easy to use, and safe for children.

The aforementioned objects and advantages may be achieved in one aspect of the present inventive concept by providing a retrofit-decorative doorstop. The doorstop may include a plush figure. The plush figure may be a stuffed animal having a filler material. The plush figure may be defined by a body with a plurality of appendages. The plurality of appendages may have a first range of motion.

The doorstop may include a clamp having a pair of arms. The clamp may be a C-shaped clamp. The pair of arms may have a second range of motion. The second range of motion may be less than the first range of motion. Each of the pair of arms may be positioned into adjacent ones of the plurality of appendages. Each of the pair of arms may be operable to (i) restrict movement of the adjacent ones of the plurality of appendages, (ii) enable the adjacent ones of the plurality of appendages to securely receive a portion of a door therebetween, and/or (iii) prevent the door from abutting a portion of a doorframe. The pair of arms may be (i) resilient, (ii) biased towards each other, and/or (iii) operable to impart a clamping force through the adjacent ones of the plurality of appendages and on the door. The clamp may be at least partially surrounded by the filler material. A portion of the filler material in the adjacent ones of the plurality of appendages may be displaced by the pair of arms.

The plush figure may include an opening, which may enable insertion or removal of the clamp from inside the plush figure. The opening may be formed and sealed via a fastener secured to the figure.

The doorstop may include an illumination system, which may be positioned inside the plush figure. The illumination system may have at least one light source, a power source, and/or a power switch. The at least one light source or the power switch may be positioned in others of the plurality of appendages.

The doorstop may include a fastener, which may be operable to secure at least one of the pair of arms into the adjacent ones of the plurality of appendages.

The aforementioned may be achieved in an aspect of the present inventive concept by providing a method of forming a retrofit-decorative doorstop. The method may include the step of forming an opening in a plush figure. The figure may be a stuffed animal, which may have a filler material. The figure may be defined by a body with a plurality of appendages. The plurality of appendages may have a first range of motion. The opening may be formed and sealed via a fastener secured to the figure.

The method may include the step of inserting a clamp into the figure via the opening. The clamp may be a C-shaped clamp. The clamp may have a pair of arms. The pair of arms may have a second range of motion which may be less than the first range of motion. The pair of arms may be (i) resilient, (ii) biased towards each other, and/or (iii) operable to impart a clamping force through the adjacent ones of the plurality of appendages and on the door. The clamp may be at least partially surrounded by the filler material.

The method may include the step of positioning each of the pair of arms into adjacent ones of the plurality of appendages to form the doorstop. The pair of arms may be operable to (i) restrict movement of the adjacent ones of the plurality of appendages, (ii) enable the adjacent ones of the plurality of appendages to securely receive a portion of a door therebetween, and/or (iii) prevent the door from abutting a portion of a doorframe. The step of positioning each of the pair of arms into the adjacent ones of the plurality of appendages may include displacing a portion of the filler material.

The method may include the step of sealing the opening to secure the clamp inside the figure. The opening may be formed and sealed via a fastener secured to the figure.

The method may include the step of inserting an illumination system inside the figure. The illumination system may have at least one light source, a power source, and/or a power switch. The method may include the step of positioning the at least one light source and/or the power switch in others of the plurality of appendages.

The method may include the step of securing, via a fastener, at least one of the pair of arms into the adjacent ones of the plurality of appendages.

The foregoing is intended to be illustrative and is not meant in a limiting sense. Many features of the embodiments may be employed with or without reference to other features of any of the embodiments. Additional aspects, advantages, and/or utilities of the present inventive concept will be set forth in part in the description that follows and, in part, will be apparent from the description, or may be learned by practice of the present inventive concept.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present inventive concept is not limited to the precise embodiments and features shown. The accompanying drawings, which are incorporated in and constitute a part of this specification, illustrate an embodiment of apparatuses consistent with the present inventive concept and, together with the description, serve to explain advantages and principles consistent with the present inventive concept.

DETAILED DESCRIPTION

Figure 1A:
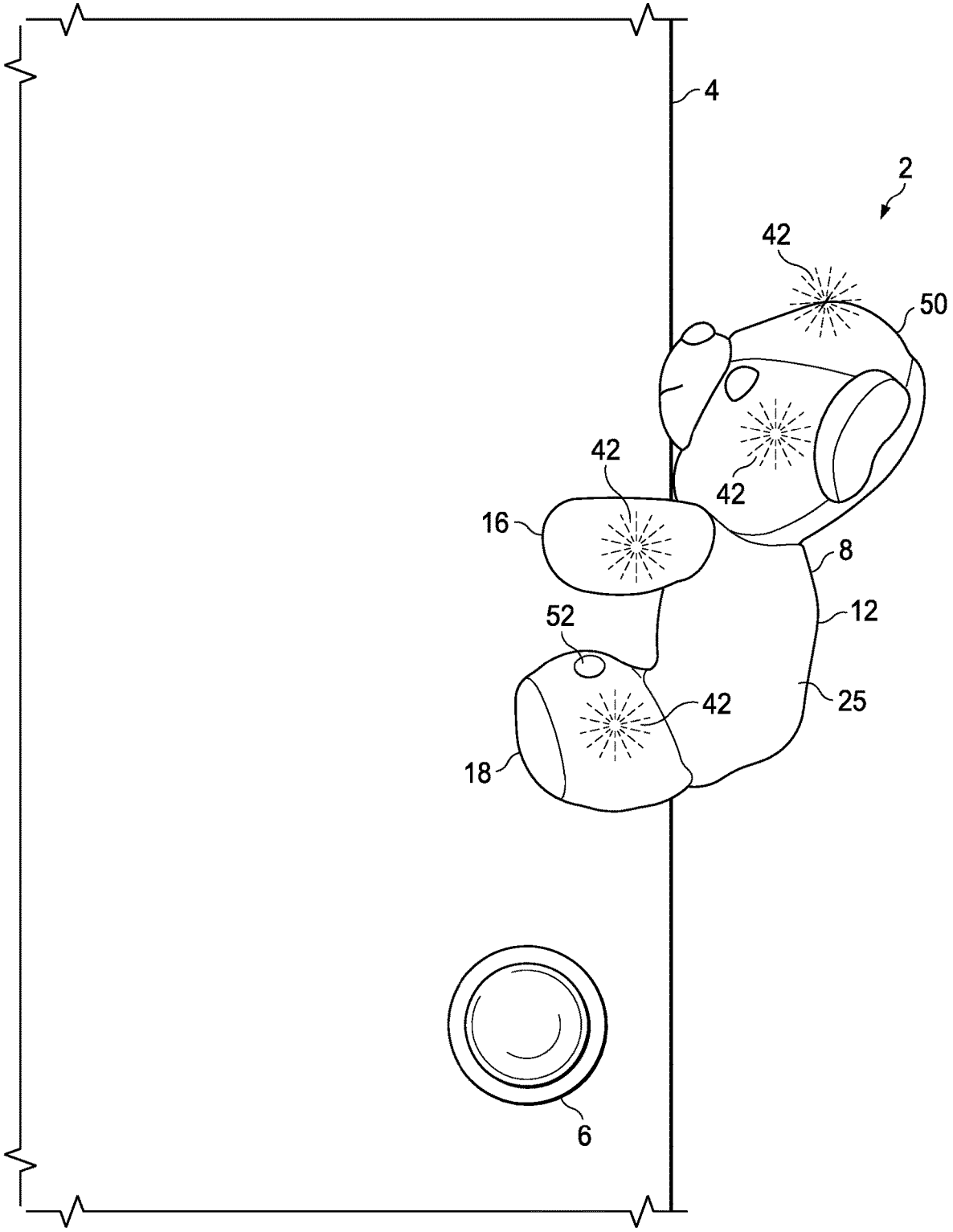
FIG. 1A is a diagram illustrating a side elevation view of a doorstop secured on a side of a door.

It is to be understood that the present inventive concept is not limited in its application to the details of construction and to the embodiments of the components set forth in the following description or illustrated in the drawings. The figures and written description are provided to teach any person skilled in the art to make and use the inventions for which patent protection is sought. The present inventive concept is capable of other embodiments and of being practiced and carried out in various ways. Persons of skill in the art will appreciate that the development of an actual commercial embodiment incorporating aspects of the present inventive concept will require numerous implementations—specific decisions to achieve the developer's ultimate goal for the commercial embodiment. While these efforts may be complex and time-consuming, these efforts, nevertheless, would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present inventive concept or the appended claims. Further, it should be understood that any one of the features of the present inventive concept may be used separately or in combination with other features. Other systems, methods, features, and advantages of the present inventive concept will be, or become, apparent to one with skill in the art upon examination of the figures and the detailed description. It is intended that all such additional systems, methods, features, and advantages be included within this description, be within the scope of the present inventive concept, and be protected by the accompanying claims.

Further, as the present inventive concept is susceptible to embodiments of many different forms, it is intended that the present disclosure be considered as an example of the principles of the present inventive concept and not intended to limit the present inventive concept to the specific embodiments shown and described. Any one of the features of the present inventive concept may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present inventive concept may include a variety of combinations and/or integrations of the embodiments described herein. Additionally, all aspects of the present disclosure, as described herein, are not essential for its practice. Likewise, other systems, methods, features, and advantages of the present inventive concept will be, or become, apparent to one with skill in the art upon examination of the figures and the description. It is intended that all such additional systems, methods, features, and advantages be included within this description, be within the scope of the present inventive concept, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

Turning to FIG. 1A, a retrofit-decorative doorstop 2 of the present inventive concept is shown in use on a door 4. The doorstop 2 is secured to a side of the door 4 by a user of the doorstop 2. In this manner, the doorstop 2 is operable to prevent the door 4 from abutting a portion of a doorframe, e.g., a doorjamb, which prevents the door 4 from closing. It is foreseen that the doorstop 2 can be secured at any portion or height of the door 4, a top of the door 4, or a pair of doorknobs 6 of the door 4. The doorstop 2 includes a decorative, outer shell 8. Although the outer shell 8 is depicted in the form of a stuffed-animal bear, it is foreseen that the outer shell 8 may be formed to have another appearance. For example, the outer shell 8 may be of another stuffed or plush figure, a non-stuffed, solid character, or a combination thereof including, but not limited to a tiger, a dog, a cat, a horse, a moose, a lion, a robot, a figurine, or a fabric sleeve without deviating from the scope of the present inventive concept. It is foreseen that the outer shell 8 can be any shape, size, or color without deviating from the scope of the present inventive concept. In the exemplary embodiment, the outer shell 8 is formed from a plush felt, although it is foreseen that the outer shell 8 can be formed from any material such as, but not limited to, velvet, faux fur, fabric, polyester, cotton, or the like, without deviating from the scope of the present inventive concept. The outer shell 8 is defined by a body 12 having a plurality of appendages, i.e., an upper pair of appendages 16 and a lower pair of appendages 18. It is foreseen that the outer shell 8 can be formed with only a single pair of appendages or more than two pairs of appendages without deviating from the scope of the present inventive concept.

Figure 1B:
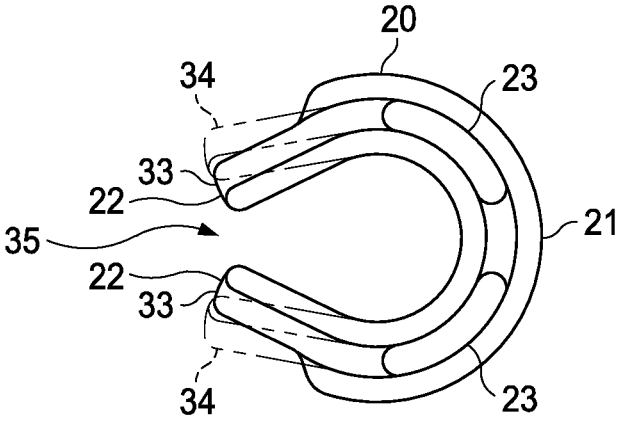
FIG. 1B is a diagram illustrating a top plan view of a clamp of the doorstop, shown in FIG. 1A.

Turning to FIG. 1B, a diagram illustrating a top plan view of a clamp 20 of the present inventive concept is shown. The clamp 20 includes a clamp body 21 and a pair of arms 22. Each of the pair of arms 22 is narrower than the clamp body 21, thereby allowing each of the pair of arms 22 to fit into adjacent ones of the plurality of appendages 16, 18. In the exemplary embodiment, the clamp 20 is formed of plastic, thereby allowing the pair of arms 22 to be resilient. It is foreseen, however, that the clamp 20 may be formed of one or more other resilient materials including, but not limited to one or more plastics, rubber, metal, or the like, or a combination thereof without deviating from the scope of the present inventive concept. One skilled in the art will recognize that different dimensions, types, and thicknesses of materials may be utilized when taking into consideration design and stability considerations, with the objective that the pair of arms 22 be sized and shaped to fit at least partially within the adjacent ones of the plurality of appendages 16, 18. In the exemplary embodiment, the clamp 20 is C-shaped, although it is foreseen that the clamp 20 can be any shape, such as, but not limited to U-shaped or G-shaped, without deviating from the scope of the present inventive concept. In the exemplary embodiment, the clamp 20 includes a pair of apertures 23. Each of the pair of apertures 23 changes in shape during use when the clamp 20 is deformed, thereby providing increased resiliency to the clamp 20. It is foreseen that the clamp 20 can be solid, e.g., without any apertures, without deviating from the scope of the present inventive concept.

Figure 3:
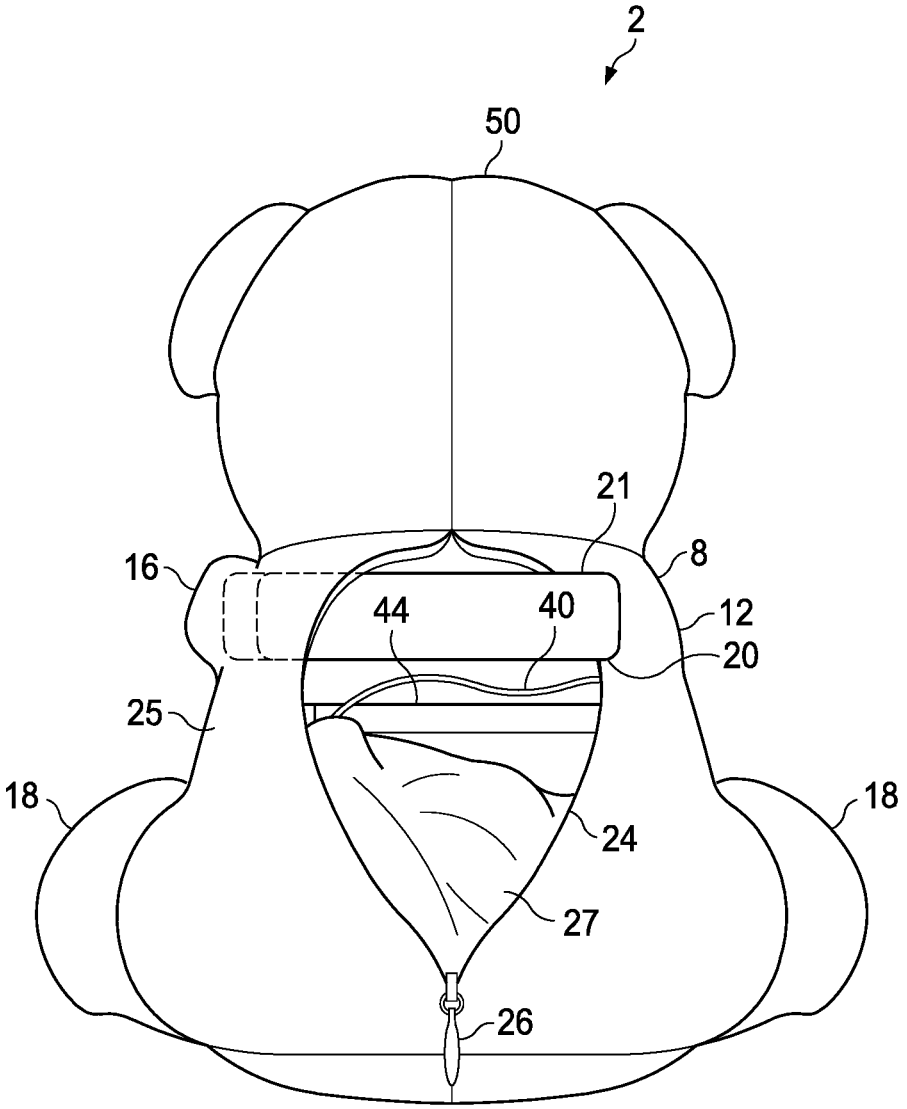
FIG. 3 is a diagram illustrating a partially exploded, back elevation view of the doorstop shown in FIG. 1A.

The clamp 20 is inserted into the outer shell 8 by the user of the doorstop 2 after an opening 24 on a back 25 of the outer shell 8 has been formed by the user as shown in FIG. 3. In the exemplary embodiment, the opening 24 is selectively formed and sealed via a fastener 26 secured to the outer shell 8, e.g. a zipper. The fastener 26 enables both easy insertion and removal of the clamp 20 from the outer shell 8. It is foreseen that the opening 24 can be selectively or permanently sealed via stitching, an adhesion, tape, a hook and loop fastener sold under the Trade Mark VELCRO, or the like, without deviating from the scope of the present inventive concept. After insertion of the clamp 20 into the outer shell 8, the clamp 20 is at least partially surrounded by a filler material 27, e.g. stuffing, of the outer shell 8.

Each of the pair of arms 22 is positioned into adjacent ones of the plurality of appendages 16, 18. It is foreseen that each pair of arms 22 can be positioned into adjacent ones of the upper pair of appendages 16 and/or adjacent ones of the lower pair of appendages 18. During and after positioning of the pair of arms 22, a portion of the filler material 27 in the adjacent ones of the plurality of appendages 16, 18 is displaced by the pair of arms 22. In the exemplary embodiment, each of the pair of arms 22 is selectively insertable and removable by the user within the adjacent ones of the upper pair of appendages 16. In another example, one or more of the pair of arms 22 is permanently secured to one or more of the upper pair of appendages 16 via an internal fastener, e.g., by sewing a strip of material around one or more portions of the clamp 20 and the plurality of upper appendages 14 and/or via an adhesive, thereby preventing removal of the clamp 20 from within the outer shell 8 after the clamp 20 has been permanently installed within the outer shell 8.

Figure 4:
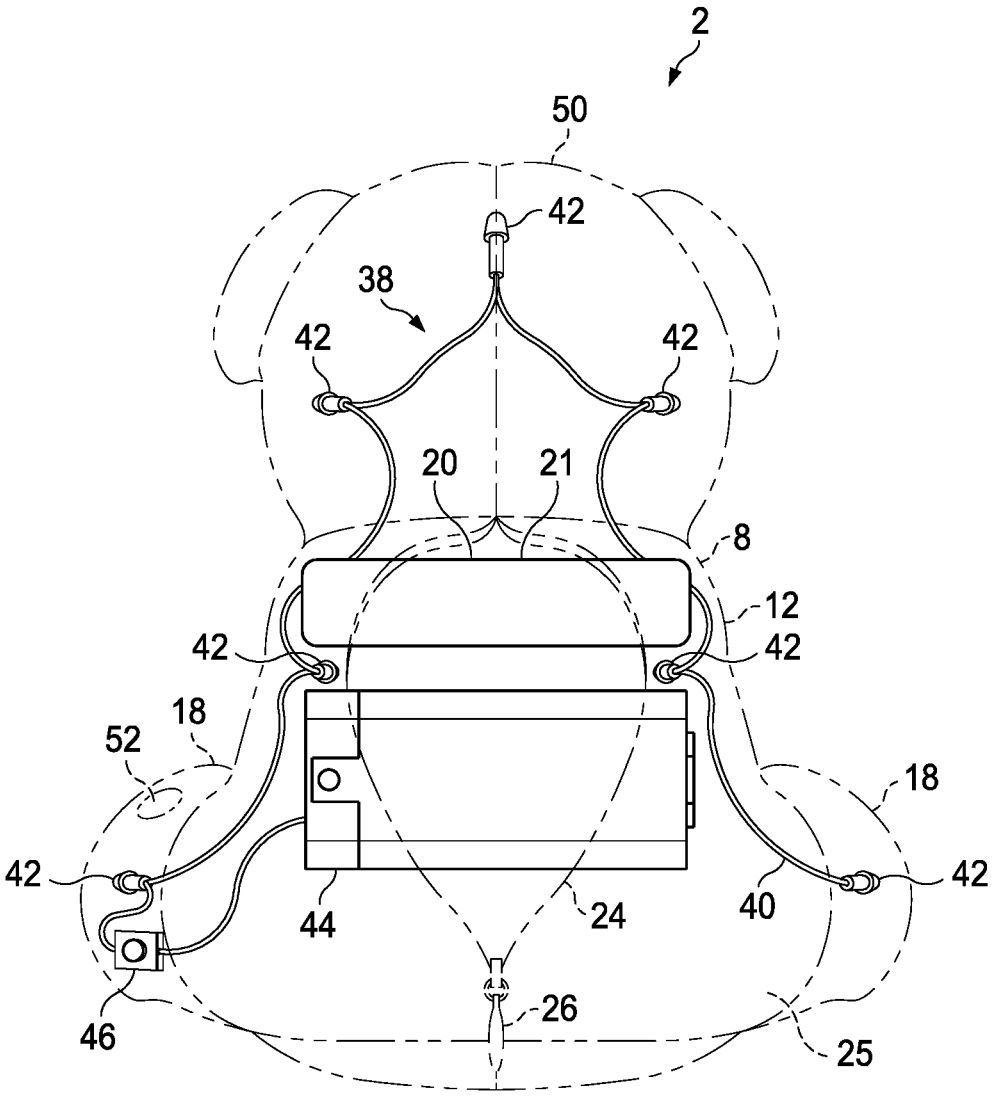
FIG. 4 is a diagram illustrating an assembled, back elevation view of the doorstop shown in FIG. 1A.

In the exemplary embodiment, each of the pair of arms 22 is positioned into each of the upper pair of appendages 16, as shown in FIGS. 3-4. In another example, each of the pair of arms 22 is positioned into each of the lower pair of appendages 18. In yet another example, each of the pair of arms 22 is positioned into each of the upper pair of appendages 16 and each of another pair of arms of another clamp is positioned into each of the lower pair of appendages 18. In another example, each of the pair of arms 22 is positioned into one of the upper pair of appendages 16 and one of the lower pair of appendages 18 and each of another pair of arms of another clamp is positioned into another one of the upper pair of appendages 16 and another one of the lower pair of appendages 18. It is foreseen that more than two clamps 20 may be positioned into the outer shell 8 or that each of the pair of arms 22 may be positioned into any appendage of the outer shell 8 without deviating from the scope of the present inventive concept.

Figure 1C:
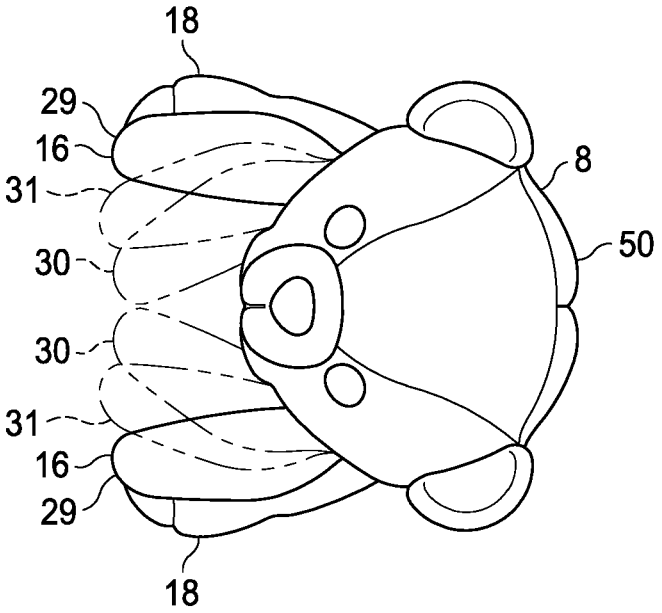
FIG. 1C is a diagram illustrating another top plan view of a range of motion of the doorstop, shown in FIG. 1A.

Turning to FIG. 1C, a diagram illustrating another top plan view of the outer shell 8 of the present inventive concept is shown. The upper pair of appendages 16 of the outer shell 8 has a first range of motion, which extends at least between a pre-existing configuration 29 and an installed configuration 30. Between the configurations 29, 30 is a secured configuration 31, which will be further discussed hereafter. In the exemplary embodiment, the upper pair of appendages 16 is non-resilient with respect to each other, so the first range of motion is only restricted by other parts of the outer shell 8. The pair of arms 22 of the clamp 20 has a second range of motion, as shown in FIG. 1B, which extends between a pre-installation configuration 33 and a deformed configuration 34. Given the resilient material of the clamp 20, the range of motion of the clamp 20 is less than the first range of motion of the upper pair of appendages 16, given the non-resilient nature of the upper pair of appendages 16 of the outer shell 8. The deformed configuration 34 is wider than the pre-installation configuration 33. When the pair of arms 22 move from the pre-installation configuration 33 to the deformed configuration 34, a variable space 35 between the pair of arms 22 increases and conversely, decreases when the pair of arms 22 moves from the deformed configuration 34 to the pre-installation configuration 33. The variable space 35 becomes wide enough in the deformed configuration 34 to receive a portion of the door 4 therebetween during installation by the user.

The first range of motion of the upper pair of appendages 18 extends between (1) the pre-existing configuration 29 defined by the upper pair of appendages 18 prior to installation of the clamp 20 into the outer shell 8; (2) the installed configuration 30 defined by the upper pair of appendages 18 after installation of the clamp 20 into the outer shell 8 and is narrower than the pre-existing configuration 29; and (3) the secured configuration 31 defined by the upper pair of appendages 18 after being secured to the door 4 and is narrower than the pre-existing configuration 29 and wider than the installed configuration 30. After the clamp 20 is installed into the outer shell 8, the outer shell 8 is restricted to the second range of motion of the clamp 20 and extends from the installed configuration 30 to the secured configuration 31. In other words, the upper pair of appendages 18 can no longer move into the pre-existing configuration 29 because each of the upper pair of appendages 18 includes a structure, e.g., each of the pair of arms 22, more rigid than the filler material 27 alone.

Figure 1D:
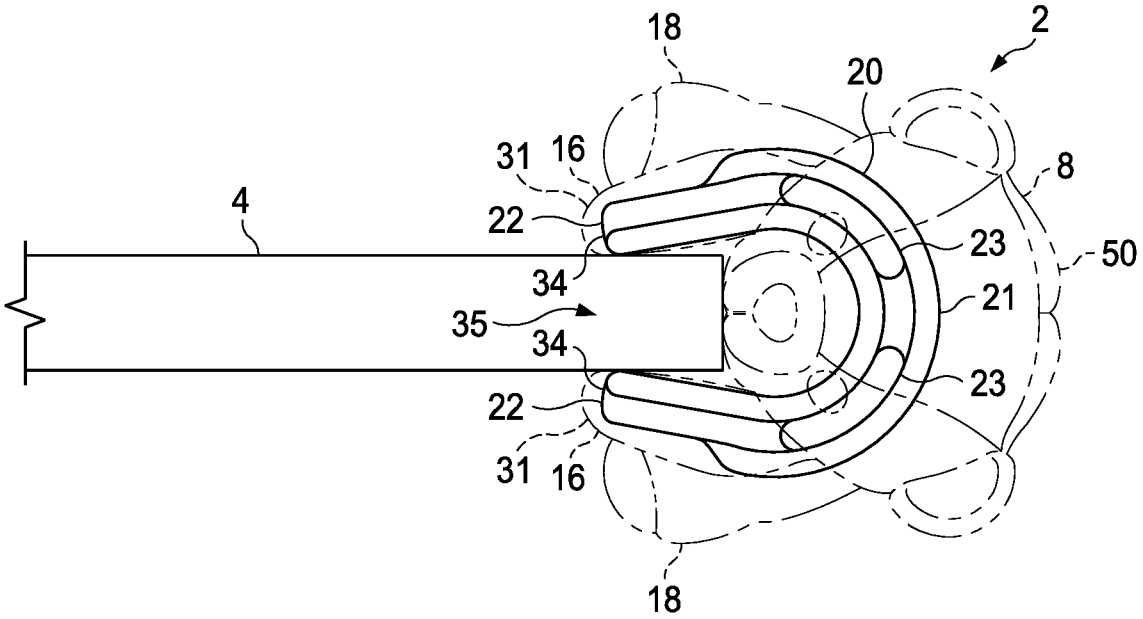
FIG. 1D is a diagram illustrating another top plan view of the doorstop highlighting the clamp, shown in FIG. 1B, secured on the side of the door, shown in FIG. 1A.

Turning to FIG. 1D, an additional top plan view of the doorstop 2 is shown, wherein the pair of arms 22 is in the deformed configuration 34 and shown in solid and the upper pair of appendages 16 is in the secured configuration 31 and shown in phantom. Each of the pair of arms 22 is operable to enable the adjacent ones of the upper pair of appendages 18 to securely receive the portion of the door 4 so that the doorstop 2 is secured thereto along any portion of the door 4. Due to the resiliency of the clamp 20, the user is able to push the clamp 20 onto an edge of the door 4, which extends through the variable space 35 until the edge of the door 4 abuts a front surface of the doorstop 2, thereby moving the pair of arms 22 from the pre-installation configuration 33 and into the deformed configuration 34. The clamp 20 is secured to the door 4 due to the resiliency of the pair of arms 22 in that each of the pair of arms 22 is biased towards each other and to the pre-installation configuration 33. As such, when the doorstop 2 is secured on the door 4, each of the pair of arms 22 imparts a clamping force through the adjacent ones of the upper pair of appendages 18 onto the door 4. In other words, the clamp and each of the pair of arms 22 convert the pair of arms 22 from the deformed configuration 34 to the narrower pre-installation configuration 33. Stated differently, the pair of arms 22 is biased towards a size of the variable space 35 that is less than a width of the door 4. In this manner, the clamp 20 imparts the clamping force onto the door 4.

Figure 1E:
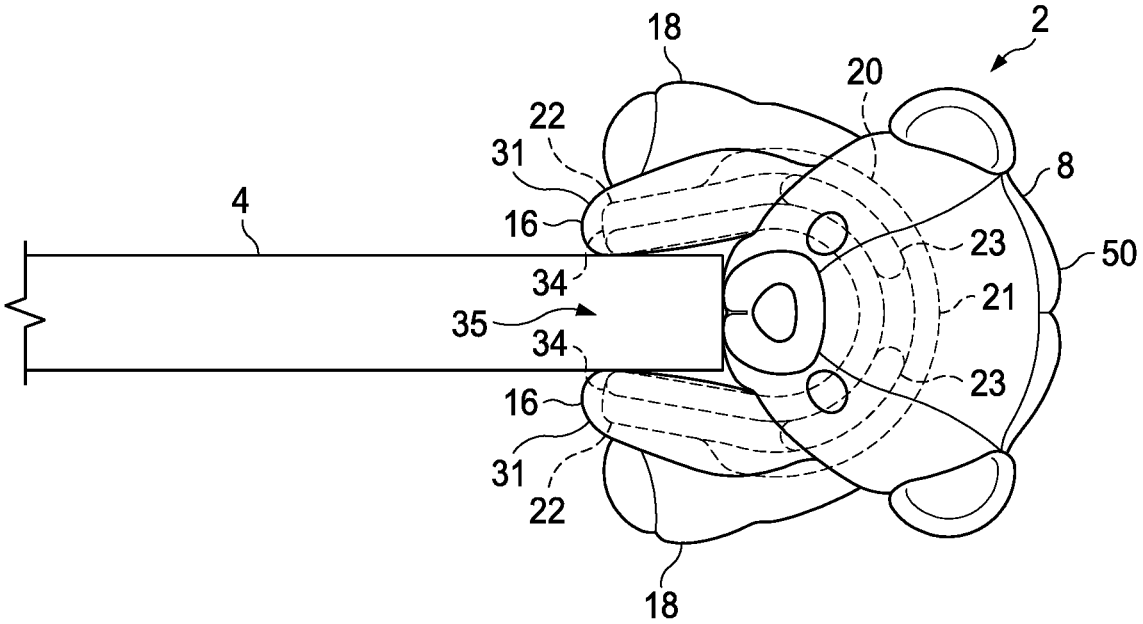
FIG. 1E is a diagram illustrating another top plan view of the doorstop secured on the side of the door, shown in FIG. 1A.

Turning to FIG. 1E, another top plan view of the doorstop 2 in the secured configuration 31 is shown, wherein the outer shell 8 is shown in solid and the clamp 20 is shown in phantom. During use, the user pushes the doorstop 2 onto the door 4, which moves the upper pair of appendages 18 from the installed configuration 30 to the secured configuration 31. In this manner, the doorstop 2 is secured to the door 4 and does not damage or leave any marks on the door 4 when the doorstop 2 is removed from the door 4 by pulling the doorstop 2 from the door. The force required by the user to install and remove the doorstop 2 from the door 4, as dictated by the clamping force of the clamp 20 within the shell 8, is equal to each other and such that the user can readily exert such force on the doorstop 2, while a child or a dog is less able to exert such force on the doorstop 2. The doorstop 2, by way of the clamp 20, can be securely fastened on any portion of the door 4, thereby allowing the user to use the doorstop 2 regardless of a height of the user. After being secured to the door 4, the doorstop 2 prevents the door 4 from abutting the portion of the doorframe by obstructing the path between the door 4 and the doorframe. In other words, the doorstop 2 creates an obstruction, thereby physically preventing the door 4 from abutting the doorframe. In this manner, the doorstop 2 creates a space between the door 4 and the doorframe. The doorstop 2 advantageously prevents the door 4 from shutting on an appendage or body of the user or other person or an animal, thereby lowering the risk of a door-related injury and/or preventing the user, e.g., the child or an elderly person, or the animal from being trapped in a room. In an alternative use, the doorstop 2 can have two clamps 20, with each clamp 20 secured to the door 4, thereby providing additional support for a larger doorstop 2.

Figure 2:
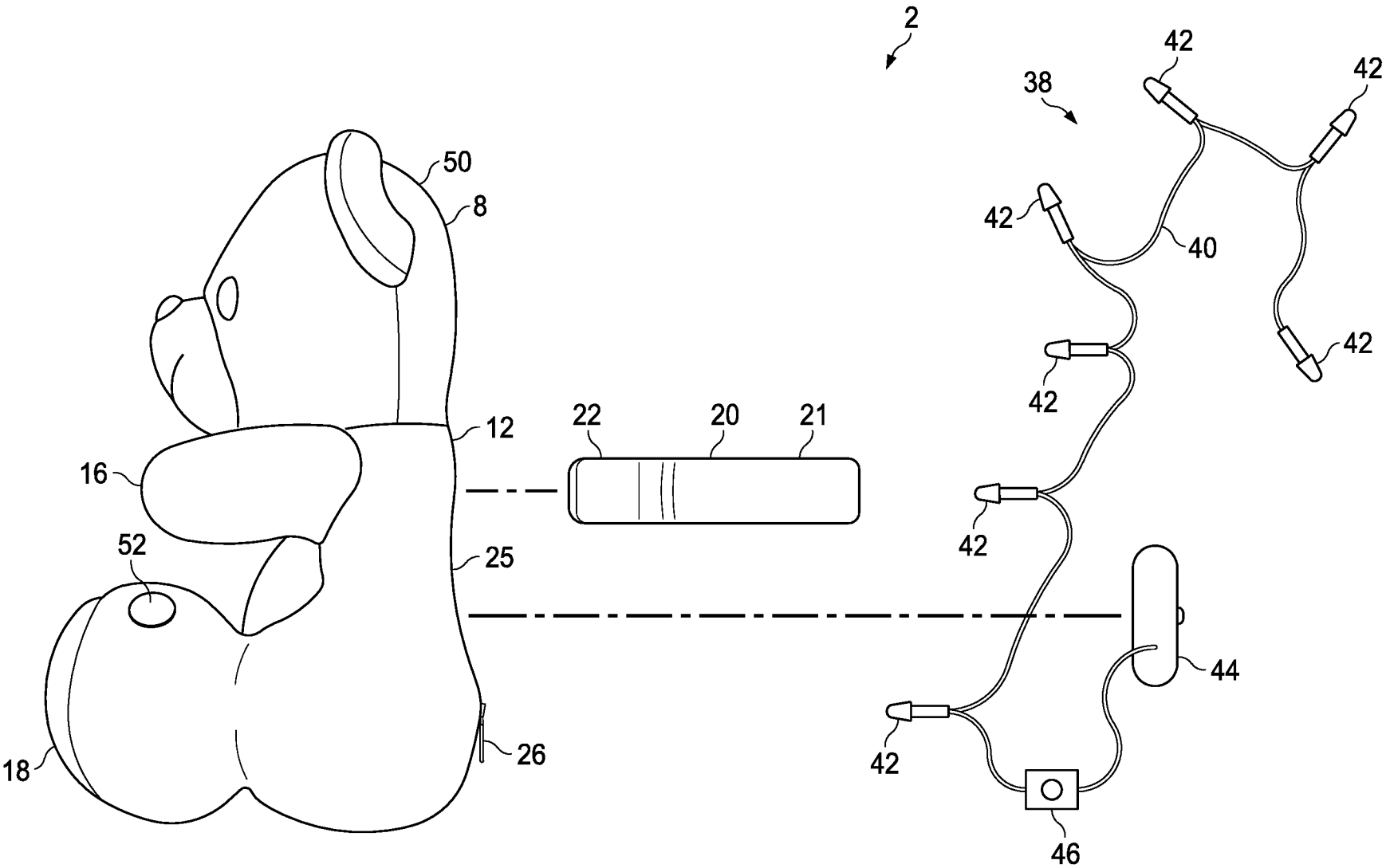
FIG. 2 is a diagram illustrating an exploded, isometric view of the doorstop shown in FIG. 1A.

Turning to FIGS. 2-4, an illumination system 38 is shown. The illumination system 38 includes an electrical wire 40 connecting a plurality of light sources 42 to a power source 44, which is operable to be selectively toggled to supply power to and shutoff power to the plurality of light sources 42 by a power switch 46. In the illustrated embodiment shown in FIG. 4, each of the plurality of light sources 42 includes a light-emitting diode. In the exemplary embodiment, the power switch 46 is a button operable to toggle the power source 44 between on and off by the user. It is foreseen that the power switch 46 can be an electrical switch, haptic sensor, or the like, without deviating from the scope of the present inventive concept. In the exemplary embodiment, the power source 44 is a battery, although it is foreseen that the power source 44 can be a solar panel without deviating from the scope of the present inventive concept. The illumination system 38 also includes an indicator 52 positioned adjacent to the power switch 46, which is concealed within the outer shell 8. In this manner, the indicator 52 advantageously allows the user to easily locate and actuate the power switch 46 inside the outer shell 8 from outside the outer shell 8. In the exemplary embodiment, the power switch 46 is positioned directly below the indicator 52, within one of the lower pair of appendages 16, such that when the user presses down on the indicator 52 the user will press down onto a portion of the power switch 46, thereby locating and actuating the power switch 46 to either an on or off position. In the exemplary embodiment, the indicator 52 is a sticker that includes the phrase "press here" or the like, which is adhered onto the outer shell 8. In another example, the indicator 52 is a patch sewn or adhered onto the outer shell 8. It is foreseen that the doorstop 2 may be manufactured without the indicator 52 without deviating from the scope of the present inventive concept.

The illumination system 38 is inserted into the outer shell 8 by the user via the opening 24. In the exemplary embodiment, the plurality of light sources 42 are positioned in the plurality of appendages 16, 18 and a head 50 of the outer shell 8, although it is foreseen that the plurality of light sources 42 can be positioned in any part of the outer shell 8, e.g. any combination of the head 50, the body 12, and/or the plurality of appendages 16, 18, without deviating from the scope of the present inventive concept. The power source 44 and the power switch 46 are inserted into the outer shell 8 by the user. In the exemplary embodiment, the power source 44 is positioned near the opening 24, thereby allowing for direct access to the user to check or maintain the power source 44, and the power switch 46 is positioned in one of the lower pair of appendages 16. It is foreseen that the power switch 46 and/or power source 44 can be located in any part of the outer shell 8 or outside of the outer shell 8 without deviating from the scope of the present inventive concept. The indicator 52 is positioned by the user on an outside surface of the same one of the lower pair of appendages 18 as the power switch 46, thereby allowing the user to easily find the power switch 46 located inside the same one of the lower pair of appendages 18, although it is foreseen that the indicator 52 and power switch 46 can be located in any portion of the outer shell 8.

The illumination system 38 advantageously allows for the doorstop 2 to simultaneously act as the doorstop 2 and a night light, as shown in FIG. 1A, allowing the user to navigate the room or easily locate the door 4 in the dark. Furthermore, the illumination system 38 may provide comfort to users, such as young children, who may be fearful of the dark. It is foreseen that the doorstop 2 can be retrofitted and used without the illumination system 38 without deviating from the scope of the present inventive concept.

Figure 5:
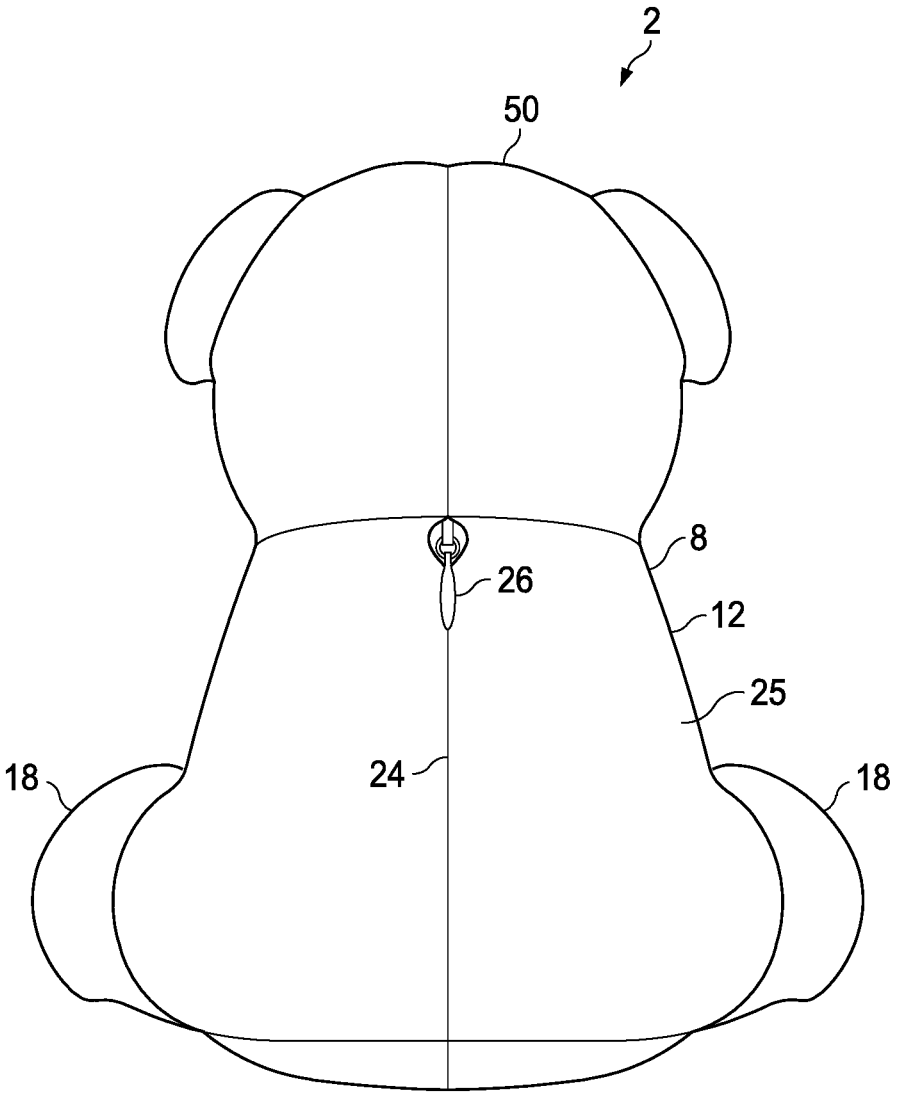
FIG. 5 is a diagram illustrating a back elevation view of the doorstop shown in FIG. 1A.

Turning to FIG. 5, the outer shell 8 is shown with the fastener 26 fastened so that the opening 24 is closed. The doorstop 2 is advantageously self-contained, providing an aesthetically clean and simple finish to the doorstop 2. Furthermore, there are no moving parts required for use or elastics which need to be stretched for use, thereby providing a simple to use and more durable doorstop 2. The outer shell 8 also provides a decorative aspect to the doorstop 2 and may be comforting or soothing to users, such as young children.

Accordingly, the present inventive concept provides a retrofit-decorative doorstop that is operable to prevent a door from abutting a portion of a doorframe and having a clamp retrofitted to a plush figure that is easy to use, simple, and is well adapted for the intended usage thereof.

One of skill in the art will recognize that the described examples are not limited to any particular size. Further, one of skill in the art will recognize that the components of the doorstop 2 are not limited to any type of material, size, or dimension.

It will be appreciated by those skilled in the art that changes could be made to the embodiments described above without departing from the broad inventive concept thereof. It is understood, therefore, that the present invention disclosed herein is not limited to the particular embodiments disclosed, and is intended to cover modifications within the spirit and scope of the present invention.

What is claimed is:

1. A retrofit-decorative doorstop comprising:

a plush figure defined by a first body with a plurality of appendages, the plurality of appendages having a first range of motion; and a clamp including:

a second body having a plurality of apertures, and a pair of arms extending from the second body and having a second range of motion that is less than the first range of motion, the second range of motion extending between a first configuration and a second configuration, the pair of arms positioned into adjacent ones of the plurality of appendages and operable to:

(i) restrict movement of the adjacent ones of the plurality of appendages, (ii) enable the adjacent ones of the plurality of appendages to securely receive a portion of a door in a variable space defined by ends of the pair of arms, the variable space including a variable space opening between the ends of the pair of arms in the first configuration and the second configuration, and (iii) prevent the door from abutting a portion of a doorframe, wherein, the first configuration is when the portion of the door has not been received by the adjacent ones of the plurality of appendages and the pair of arms has not been deformed, the second configuration is when the portion of the door has been received by the adjacent ones of the plurality of appendages and the pair of arms been deformed, and the variable space opening between the ends of the pair of arms is a first width in the first a first width in the first configuration and a second width in the second configuration, the second width is greater than the first width.

2. The doorstop of claim 1, wherein, the plush figure includes a plush figure opening to enable insertion or removal of the clamp from the plush figure.

3. The doorstop of claim 2, wherein, the plush figure opening is formed and sealed via a fastener secured to the plush figure.

4. The doorstop of claim 1, further comprising:

an illumination system positioned inside the plush figure, the illumination system having a plurality of light sources, a power source, and a power switch.

5. The doorstop of claim 4, wherein, at least one of the plurality of light sources or the power switch is positioned in others of the plurality of appendages.

6. The doorstop of claim 1, wherein, the pair of arms (i) are resilient, (ii) biased towards each other, (iii) operable to impart a clamping force through the adjacent ones of the plurality of appendages and on the door.

7. The doorstop of claim 1, wherein, the clamp is a C-shaped clamp.

8. The doorstop of claim 1, wherein, the plush figure is a stuffed animal having a filler material, and the clamp is at least partially surrounded by the filler material.

9. The doorstop of claim 8, wherein, a portion of the filler material in the adjacent ones of the plurality of appendages is displaced by the pair of arms.

10. The doorstop of claim 1, further comprising:

a fastener operable to secure at least one of the pair of arms into the adjacent ones of the plurality of appendages.

11. The doorstop of claim 1, wherein, the pair of arms is operable to move from the first configuration to the second configuration when the doorstop is pushed onto the portion of the door with the portion of the door extending into the variable space until an edge of the door indirectly abuts an abutment surface extending between the pair of arms, and the abutment surface is spaced from the edge of the door by a portion of the plush figure when the edge of the door is indirectly abutted to the abutment surface.

12. A method of forming a retrofit-decorative doorstop, the method comprising the steps of:

forming a plush figure opening in a plush figure, the plush figure defined by a first body with a plurality of appendages, the plurality of appendages having a first range of motion;

inserting a clamp into the plush figure via the plush figure opening, the clamp including:

(i) a second body having a plurality of apertures, and (ii) a pair of arms extending from the second body, the pair of arms having a second range of motion that is less than the first range of motion, the second range of motion extending between a first configuration and a second configuration; and positioning the pair of arms into adjacent ones of the plurality of appendages to form the doorstop, the pair of arms operable to:

(i) restrict movement of the adjacent ones of the plurality of appendages, (ii) enable the adjacent ones of the plurality of appendages to securely receive a portion of a door in a variable space defined by ends of the pair of arms, the variable space including a variable space opening between the ends of the pair of arms in the first configuration and the second configuration, and (iii) prevent the door from abutting a portion of a doorframe, wherein, the first configuration is when the portion of the door has not been received by the adjacent ones of the plurality of appendages and the air of arms has not been deformed, the second configuration is when the portion of the door has been received by the adjacent ones of the plurality of appendages and the pair of arms has been deformed, and the variable space between the ends of the pair of arms is a first width in the first configuration and a second width in the second configuration, the second width greater than the first width.

13. The method of claim 12, further comprising the step of:

sealing the plush figure opening to secure the clamp inside the plush figure.

14. The method of claim 13, wherein, the plush figure opening is formed and sealed via a fastener secured to the plush figure.

15. The method of claim 12, further comprising the step of:

inserting an illumination system inside the plush figure, the illumination system having at least one light source, a power source, and a power switch.

16. The method of claim 15, further comprising the step of:

positioning the at least one light source or the power switch in others of the plurality of appendages.

17. The method of claim 12, wherein, the pair of arms (i) are resilient, (ii) biased towards each other, (iii) operable to impart a clamping force through the adjacent ones of the plurality of appendages and on the door.

18. The method of claim 12, wherein, the clamp is a C-shaped clamp.

19. The method of claim 12, wherein, the plush figure is a stuffed animal having a filler material, and the clamp is at least partially surrounded by the filler material.

20. The method of claim 12, further comprising the step of:

securing, via a fastener, at least one of the pair of arms into the adjacent ones of the plurality of appendages.

* * * * *